United States Patent [19]

Seeley

[11] 4,005,776

[45] Feb. 1, 1977

[54] PACKAGE FOR ORAL THERMOMETER, CATHETER OR THE LIKE

[75] Inventor: Leonard Seeley, Palatine, Ill.

[73] Assignee: Plastofilm Industries, Inc., Wheaton, Ill.

[22] Filed: May 2, 1975

[21] Appl. No.: 573,851

[52] U.S. Cl. ..... 206/306; 206/364; 206/461; 206/470

[51] Int. Cl.[2] ..... B65D 85/38; B65D 85/08; B65D 65/16; B65D 5/50

[58] Field of Search ..... 206/461, 467, 470, 364, 206/306, 45.34, 45.14, 330, 72, 365; 229/3.5 R; 217/26.5

[56] References Cited

UNITED STATES PATENTS

| | | | |
|---|---|---|---|
| 2,720,969 | 10/1955 | Kendall | 206/365 |
| 2,947,415 | 8/1960 | Garth | 206/364 |
| 2,952,353 | 9/1960 | Rohdin | 206/45.34 |
| 3,010,569 | 11/1961 | Goldman | 206/306 |
| 3,035,691 | 5/1962 | Rasmussen et al. | 206/364 |
| 3,133,637 | 5/1964 | Siegler | 206/330 |
| 3,182,790 | 5/1965 | Bieganowsky et al. | 206/45.34 |
| 3,581,885 | 1/1971 | Wald | 206/470 |
| 3,744,663 | 7/1973 | Moren | 217/26.5 |

*Primary Examiner*—William T. Dixson, Jr.
*Attorney, Agent, or Firm*—Darbo, Robertson & Vandenburgh

[57] ABSTRACT

A thermoformed plastic package for long, thin, round articles, such as thermometers and catheters, is provided with a receiving trough which is approximately equal in width but may be somewhat shallower than the diameter of the article, keepers being spaced along the length of the trough extending inwardly from both sides and outwardly away from the open side of the trough whereby to maximize the space efficiency of the package by minimizing the depth of the trough necessary to accomodate and retain the article therein. The keepers may be opposite each other or somewhat staggered. The oral thermometer package disclosed provides a convenient protective case for the thermometer when not in use and a container for a supply of sanitary sheaths for use with the thermometer.

10 Claims, 11 Drawing Figures

9
10
19
13
4
4
3
11
13
5
6
19
1
4
2
3

12
8
3.
10
14
3.
9
1
2
3
19
6
4
5
7

12
11

13
14
1
2
3

8
11
13
12
13
1

12

15

16

Fig. 7
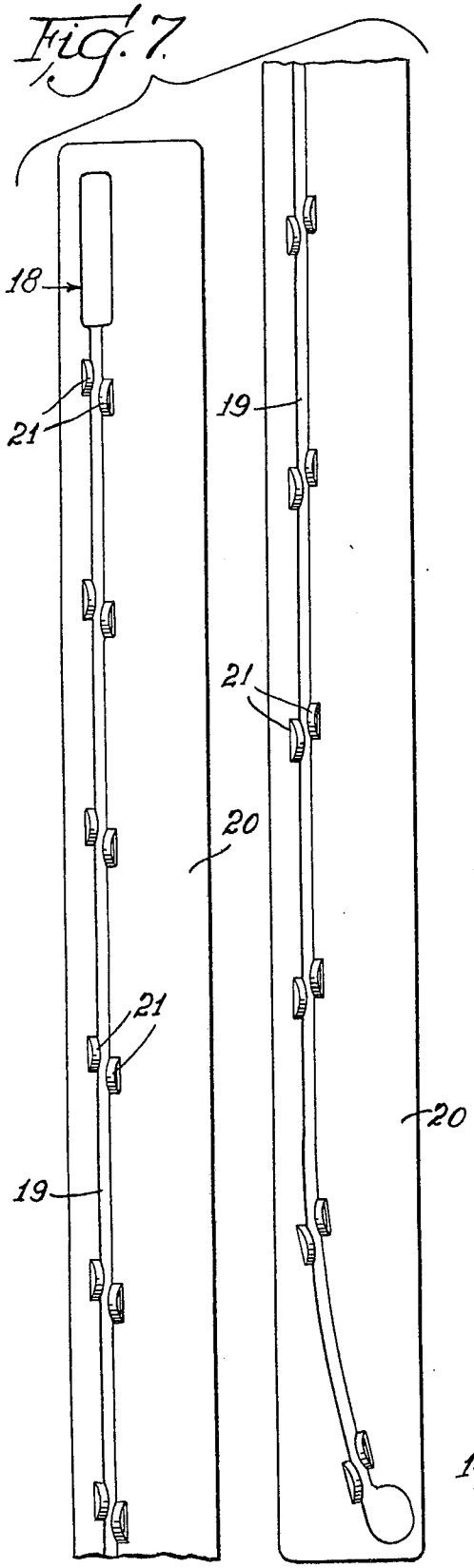
Fig. 8
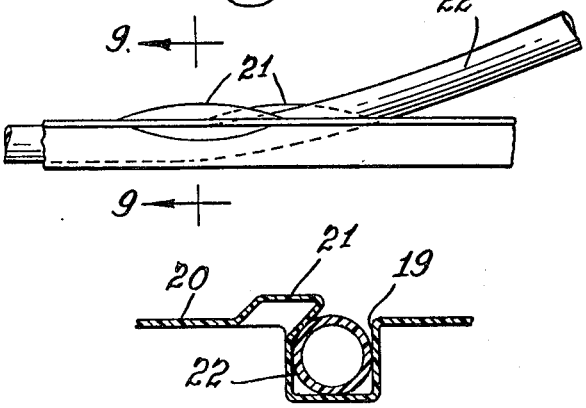
Fig. 9.
Fig. 10.
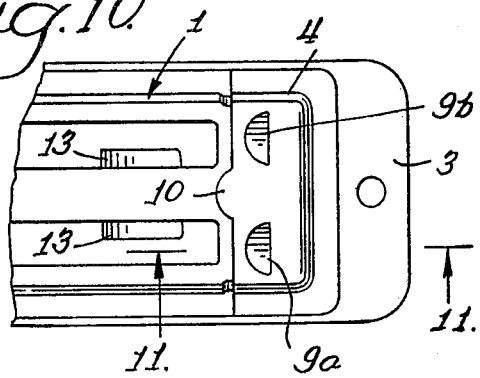
Fig. 11.
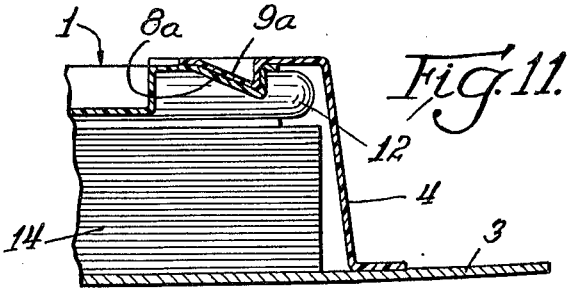

PACKAGE FOR ORAL THERMOMETER, CATHETER OR THE LIKE

BACKGROUND AND SUMMARY OF THE INVENTION

The most desirable package for an article which is to be shipped, stored and eventually used is one which at reasonable cost provides protection for the article and displays it attractively. If the package is to be more than a throwaway, it must be designed to conveniently and efficiently carry out whatever additional function it is to perform following initial opening and withdrawal of the packaged article.

Frequently a package is designed to accommodate more than a single article; that is, the package may contain a plurality of identical articles or may contain different articles, as, for example, articles to be used together. Such packages must be designed for maximum efficiency and convenience to the user.

The oral thermometer package herein described and shown as a particular example of the invention comprises (1) a protective package for the fragile thermometer, (2) space for a stack of individual sanitary sheaths, and (3) a cap by which the package may be opened for withdrawal of the thermometer and a sheath and reclosed after replacement of the thermometer to retain and protect the contents of the package. The structural design of the package is such that it can be produced at low cost by thermoforming.

The thermometer is inserted into the package by sliding it into the trough from the open end at the end of the package which is open when the cap is moved out of the way. The space requirement for the thermometer is minimized by providing keepers which extend outwardly with respect to the receiving trough as well as inwardly toward each other so that it is possible to make the trough somewhat shallower than the diameter of the thermometer. In this way, for a given thickness of the package, maximum space can be reserved for the stack of sheaths below the thermometer. Also, material requirements are minimized with resulting cost saving.

By staggering the keepers, a package for articles, such as catheters which include long, flexible plastic tubing and which may be loaded and unloaded through the open side of the trough, may be provided.

The principal object of the invention is to provide space and cost efficient protective packaging for long, thin, round articles, such as, for example, thermometers, drills and the like. A further object is to provide such a package which may be made by thermoforming plastic material.

Another object is to provide a package containing an oral thermometer and a supply of sanitary sheaths with provision for easy opening and withdrawal of the thermometer and a sheath and for reclosing of the package after reinsertion of the thermometer to protect the thermometer and remaining sheaths.

DESCRIPTION OF THE DRAWINGS

In the accompanying drawings,

FIG. 7 is a plan view of a package for a catheter showing the staggered keepers for retaining the catheter in place in the package;

FIG. 8 is a detail view showing a portion of the catheter package and a portion of the catheter tube partly in the package;

FIG. 9 is a cross-sectional view taken at the line 9—9 of FIG. 8;

FIG. 10 is a plan view of the top portion of a package similar to that of FIG. 1 but having different form of latch, and FIG. 11 is a cross-sectional view taken at the line 11—11 of FIG. 10.

DESCRIPTION OF SPECIFIC EMBODIMENTS

The conceptual matter herein contained relates to the packaging of long, round articles and the particular packages shown. The thermometer sheathing system is no part of this invention and is described only for completeness since the thermometer package is designed to contain and permit dispensing of such sheaths.

Figure 1:
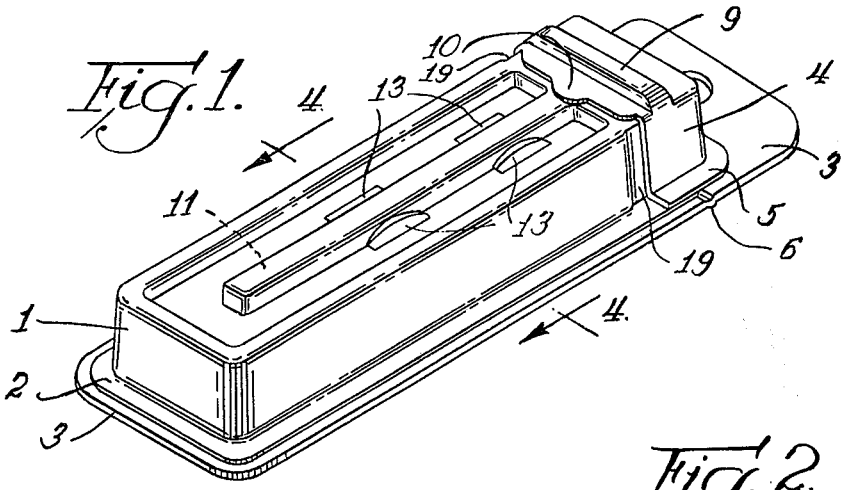
FIG. 1 is a perspective view of the oral thermometer and sanitary sheath package.
Figure 2:
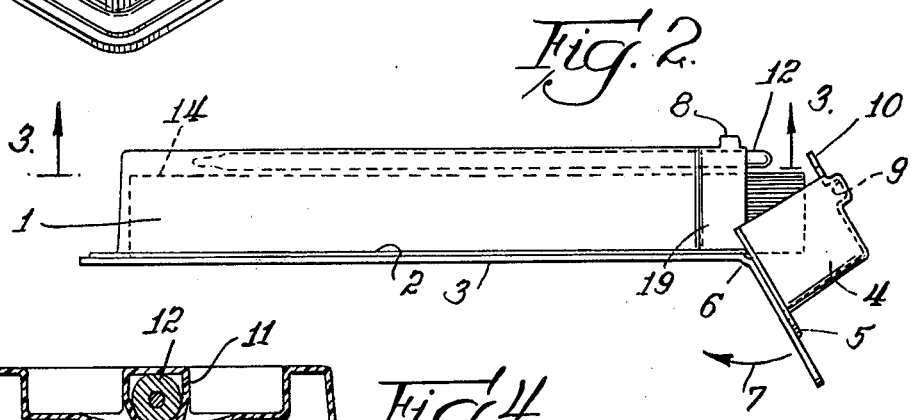
FIG. 2 is a side view of the thermometer package showing the cap partly opened.

The package shown in FIG. 1 comprises a body 1 fastened by means of flange 2 to a backing card 3 of relatively thin, tough paperboard, and a cap 4 which is also attached to the backing card 3 by means of the portion of flange 5 which does not overlap the ends of flange 2 of the body. As is shown in FIG. 2, the backing card 3 is scored at 6 to define a hinge line along which the backing card may be bent to swing cap 4 between open and closed positions, as indicated by arrow 7. As is shown in FIG. 1, the top end of backing card 3 extends well beyond cap 4 to provide a handle by which the bending may conveniently be accomplished. It will be understood that the backing card may be bent a full 180° so that a person may keep the package in open position by holding the bent back top portion of the backing card against the back of the lower portion of the card.

A latch arrangement to keep the cap locked in position upon the body of the package comprises a protruding crossbar 8 formed integrally with the body of the package across and at the open end thereof together with a corresponding recess 9 in cap 4 which nests over bar 8 when the package is closed. A lip 10 extends a short distance over the body of the package to serve as a handle for lifting the cap sufficiently to separate the latching elements and permit the cap to be swung away. This lifting is easily accomplished while holding the package in one hand by sliding the index finger or thumb (depending on how the package is being held) to engage the nail of the finger or thumb under the lip 10 to wedge the cap open.

Figure 4:
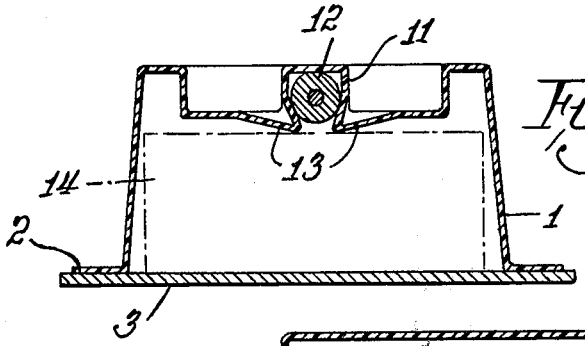
FIG. 4 is a cross-sectional view taken at the line 4—4 of FIG. 1.
Figure 3:
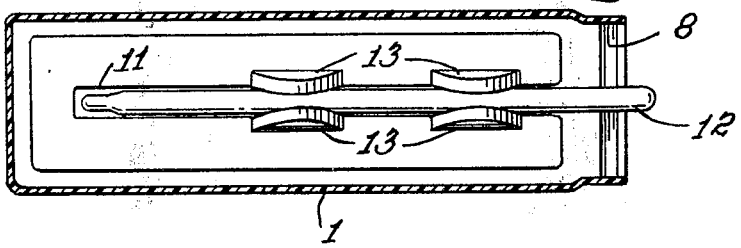
FIG. 3 is a cross-sectional view taken at the line 3—3 of FIG. 2 showing the keepers which hold the thermometer in position in the package.

A trough 11 is formed in the top of the body of the package, opening downwardly into its interior. The trough is slightly shorter than the length of the thermometer 12 and, as is best seen in FIG. 4, the trough is somewhat shallower than the diameter of the thermometer. To hold the thermometer in position within trough 11, two spaced pairs of keepers 13 are formed at the open side of the trough to reduce the opening sufficiently to prevent lateral movement of the thermometer out of the trough. The keeper elements do not merely extend toward each other in the plane of the open side of the trough, but extend outwardly as well so that the thermometer-retaining restriction is actually located somewhat outwardly from the plane of the open side of the trough. This arrangement permits the use of a shallower trough with resulting space efficiency of the package.

The employment of longitudinally spaced keepers, rather than continuously extending restriction elements, makes it possible to thermoform the package since the formed part is removable from the mold with reasonable facility. The greater distance of the crests of the keepers from the bottom of the trough also contributes to the ease of removal.

Figure 5:
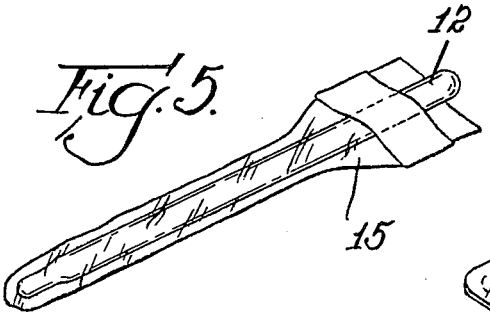
FIG. 5 is a perspective view showing the oral thermometer inserted in a sanitary sheath ready for use in taking a patient's temperature.
Figure 6:
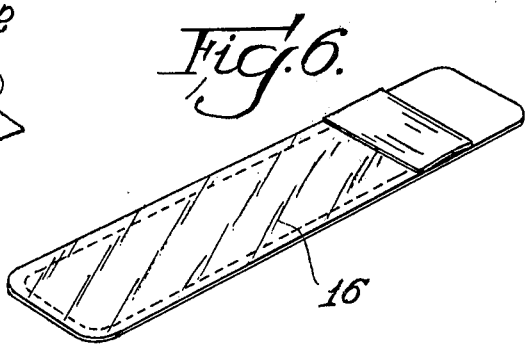
FIG. 6 is a perspective view of a pocket container for a sanitary sheath.

A stack 14 of throwaway sanitary sheaths is supplied with the thermometer in the package. Each sheath 15 of very thin plastic film is protected in the stack by a pocket 16. When the thermometer is to be used, it is withdrawn from the package and inserted into a sheath, as shown in FIG. 5, after which the sheath-enclosed thermometer is withdrawn from the pocket and placed in the mouth of the patient in accordance with standard procedure. The thermometer and contaminated sheath are then reinserted into the pocket, the thermometer is withdrawn, the temperature read and the pocket containing the contaminated sheath is discarded.

A catheter support package is shown in FIGS. 7–9. A recess 18, including a trough 19, is formed in a length 20 of plastic material which is sufficiently stiff to provide necessary strength for the package but thin and flexible enough to permit some bending as the package is being loaded and unloaded. The overall recess is shaped to receive the entire catheter. Pairs of keepers 21 are formed at spaced locations along the length of the trough. Each keeper element extends inwardly with respect to the trough at its open side and also outwardly away from the trough so that the crest of each keeper element is above the plane of the open side of the trough. As is best seen in FIG. 9, the trough is deep enough to completely contain the catheter tubing 22. The respective keeper elements of each pair are staggered somewhat to increase the actual distance between them. Thus, while the several keepers extend almost to the median plane of the trough, they are spaced apart sufficiently to permit insertion of the catheter with its flexible tubing into the trough by merely laying it over the trough and pressing it down between the keepers into the trough. Some bending of the plastic material forming the trough permits not only the loading of the catheter into the package in this way but also its removal, without violating the integrity of the catheter, by merely pulling it out beginning at one end. At the same time, the catheter is securely held in the package pending such intentional removal.

A modified arrangement for latching the cap to the body of the package is illustrated in FIGS. 10 and 11. Instead of the protruding crossbar 8, recesses 8a and 8b are provided in the top of the body of the package near the open end thereof and corresponding inwardly projecting latch elements 9*a* and 9*b* are formed in the cap to nest in recesses 8*a* and 8*b* to latch the cap in closed position. Since the recesses do not cross the center part of the top of the package, they will not interfere with the thermometer. As is seen in FIG. 11, the sloping side of the latching elements in the cap will serve to guide the cap onto the end of the package body as it is being closed. This particular latching arrangement further reduces the overall height of the package.

The necessity of removing packaging bubbles from the mold after thermoforming from plastic film imposes limitations upon the configurations that can be produced by this method. At the same time, thermoforming offers great economy of production compared to alternate methods of producing similar products. Therefore, expedients which extend the useful limits of the thermoforming procedure offer substantial savings in packaging costs. Although any design elements which would constrict the open side of the article holding troughs sufficiently to retain the articles in the troughs would ordinarily require under cuts in the mold too severe to permit removal of the bubbles from the mold, it has been found that by employing a plurality of spaced, short keepers and designing them as herein described to extend into the open side of the trough above the plane of the open side, it is possible to slip the formed bubbles from the mold without difficulty. At the same time, the usable space in the trough to accommodate the article is enlarged as compared to indents which merely extend toward each other within the trough. This makes possible saving of space and material.

I claim:

1. In a package for tubular articles including a thermoformed plastic bubble, means for receiving and retaining a long, thin article comprising a trough formed integral with the bubble and pairs of keepers spaced along the length of said trough for holding the article in said trough, each said pair of keepers comprising two keeper elements formed integral with the bubble at the open side of said trough and extending both inwardly toward the median of said trough and outwardly away from said trough whereby each said pair of keepers restricts the lateral opening of said trough with the maximum restriction being located outwardly from said trough said keepers being thermoformed concurrently with the thermoforming of the plastic bubble and with and upon the same mold.

2. Package structure in accordance with claim 1 wherein the keeper elements of each pair of keepers are opposite each other.

3. Package structure in accordance with claim 1 wherein the keeper elements of each pair of keepers are offset from direct opposition to each other.

4. Package structure in accordance with claim 1 wherein the package bubble body is horizontally elongated and the trough is formed along the median of the top side thereof, one end of said body being closed and one end being open, said trough opening downwardly into the package and being open at its end which is nearest the open end of said body whereby an article located in said trough may project through the open end of said package body.

5. Package structure in accordance with claim 4 wherein the end of the trough remote from the open end of the package body is closed short of the closed end of said body.

6. Package structure in accordance with claim 4 and including a cap adapted to close the open end of said body and hinge means for connecting said cap to said body whereby said cap may be swung between positions opening and closing said package body, and latch means for locking said cap in closed position.

7. Package structure in accordance with claim 6 wherein the latch means comprises a crossbar formed integral with the bubble and protruding upwardly from the top side near the open end thereof and a corresponding recess opening downwardly in the cap to nest onto said crossbar when said cap is in closed position.

8. Package structure in accordance with claim 6 wherein the latch means comprises a pair of spaced recesses formed integral with the bubble and opening upwardly from the top side near the open end thereof and corresponding protuberances extending downwardly from the cap to nest into said recesses when said cap is in closed position.

9. Package structure in accordance with claim 8 wherein the sides of the protuberances toward the body of the package are sloping to serve to wedge the cap upwardly as it is being swung to closed and latched position.

10. Package structure in accordance with claim 6 wherein the package includes a backing of thin, tough paper-board to which the body bubble and separate cap are attached, said backing being transversely scored at the open end of said body to define a hinge line.

* * * * *